US008616093B1

(12) United States Patent
Maniak

(10) Patent No.: US 8,616,093 B1
(45) Date of Patent: Dec. 31, 2013

(54) TORSION SPRING TORQUE ASSEMBLY

(76) Inventor: David Maniak, Loveland, CO (US)

( * ) Notice: Subject to any disclaimer, the term of this patent is extended or adjusted under 35 U.S.C. 154(b) by 792 days.

(21) Appl. No.: 12/807,223

(22) Filed: Aug. 31, 2010

Related U.S. Application Data

(60) Provisional application No. 61/275,646, filed on Sep. 1, 2009.

(51) Int. Cl.

| | |
|---|---|
| ***B25B 17/00*** | (2006.01) |
| ***B25B 21/00*** | (2006.01) |
| *E05D 15/16* | (2006.01) |
| *E05F 15/16* | (2006.01) |

(52) U.S. Cl.
USPC ..... 81/57.13; 81/57.3; 160/192

(58) Field of Classification Search
USPC ..... 81/57.13, 57.14, 57.2, 57.29, 57.3, 81/57.39, 57.4, 57.35; 160/191, 192, 201; 267/155, 175, 179; 185/39; 29/227
See application file for complete search history.

(56) References Cited

U.S. PATENT DOCUMENTS

| | | | | |
|---|---|---|---|---|
| 3,651,719 | A * | 3/1972 | Wessel | 81/63.2 |
| 3,979,977 | A * | 9/1976 | Dorma | 81/57.13 |
| 4,142,283 | A * | 3/1979 | Walker et al. | 29/227 |
| 4,253,350 | A * | 3/1981 | De Tarr | 81/486 |
| 4,374,479 | A * | 2/1983 | Minotti | 81/57.3 |
| 4,506,567 | A * | 3/1985 | Makhlouf | 81/57.3 |
| 4,526,066 | A * | 7/1985 | Steck | 81/486 |
| 4,981,165 | A | 1/1991 | Miller et al. | |
| 5,277,087 | A * | 1/1994 | Wilson et al. | 81/57.29 |
| 5,605,079 | A * | 2/1997 | Way | 81/61 |
| 6,508,461 | B1 * | 1/2003 | Trevorrow et al. | 267/155 |
| 6,527,037 | B2 | 3/2003 | Daus et al. | |
| 6,615,897 | B2 | 9/2003 | Dorma | |
| 6,735,905 | B1 | 5/2004 | Miller | |
| 7,254,868 | B2 | 8/2007 | Mullet et al. | |
| 7,686,061 | B2 * | 3/2010 | Mullet et al. | 160/191 |
| 7,784,521 | B2 * | 8/2010 | Mullet et al. | 160/201 |
| 2003/0201077 | A1 * | 10/2003 | Mullet et al. | 160/192 |

* cited by examiner

*Primary Examiner* — David B Thomas
(74) *Attorney, Agent, or Firm* — Anthony G. Eggink; Katrina M. Eggink; Eggink & Eggink

(57) ABSTRACT

A torsion spring torque assembly for applying torque to a torsion spring of a garage door system. The assembly comprises a separable housing, an adjustable support member, a gear assembly and a cooperating and movable coupling shaft assembly having a driven gear and a hub to engage the winding cone of a garage door torsion spring. The gear assembly has a driver gear which engages the driven gear of the coupling shaft to wind a garage door torsion spring. The driver gear of the gearbox assembly may be operated by means of a screw gun and is constructed to provide bi-directional rotation for winding and unwinding a garage door torsion spring.

20 Claims, 11 Drawing Sheets

TORSION SPRING TORQUE ASSEMBLY

This application claims the benefit of U.S. Provisional Patent Application Ser. No. 61/275,646, filed on Sep. 1, 2009.

FIELD OF THE INVENTION

The present invention relates generally to a torsion spring winding assembly. Particularly, the invention relates to a gear assembly and a method for winding and unwinding the torsion spring of a garage door system. More particularly, the invention relates to a bi-directional gearbox assembly for a screw gun to engage and torque the winding cone of a torsion spring of the garage door system.

BACKGROUND OF THE INVENTION

Garage door systems typically have sectional door panels that are moved vertically and horizontally via rollers in a track system. The movement force is typically provided by a cooperating cable system which is counterbalanced by a drive bar and spring assembly as a motorized chain or belt assembly is activated, for example, by a garage door opener, to raise and lower the garage door. During installation, the tension springs of the counterbalance spring assembly are wound or tensioned to a predetermined tension so that a minimal force is required to operate the garage door opening and closing sequence.

The proper adjustment of the counter balancing tension springs during installation and in maintenance procedures is often a difficult and sometimes dangerous process. The torque applied to the respective torsion springs requires that the usually fixed winding cone on the drive bar be loosened for winding or unwinding the torsion spring. Typically, elongated winding bars are used to alternately engage winding bar slots or apertures in the cone to thereby torque the spring to a specified tension. The accidental disengagement of a winding bar during this winding or unwinding process can result in unwanted and disastrous consequences.

Although various devices and apparatus have been proposed in the art to easily and safely wind the torsion springs of a garage door system, these devices have been cumbersome, inadequate and/or difficult to operate. The torsion spring torque assembly of the present invention overcomes the problems and difficulties of the prior art, and provides an assembly which easily and safely allows a torsion spring to be torqued by means of a screw gun.

SUMMARY OF THE INVENTION

A gearbox assembly for applying torque to a torsion spring of a garage door system. The gearbox assembly is constructed to provide bi-directional rotation by means of a screw gun.

The gearbox or torsion spring torque assembly comprises a reversible, bi-directional gear assembly mounted in and to a separable housing structure. The gear assembly has a driver gear structure having a ratchet gear with a movable cooperating pawl to provide the bi-directional gear rotation of the gearbox. A driver gear structure engagement means to drive the driver gear and a driver reducing gear are provided so that a screw gun may be used to rotate the driver gear of the gear assembly.

A driven gear structure having cone engagement means, such as a separable winding hub structure, communicates with the driver gear and is provided for coupling to the winding cone of the torsion spring. The cone engagement means or winding hub structure may be provided in specified sizes to accommodate various cone sizes used in the garage door industry. An adjustable plate or slidable lever arm is connected to the support or housing structure to position the gearbox structure against the garage door frame. Once in position and attached to the winding cone of a torsion spring, a screw gun with a socket can be used to engage the driver gear, thereby turning the reducing gear, the driven gear and the cone to wind or torque the torsion spring.

An advantage of the invention is to provide an easy to use assembly for mounting to the winding cone of a torsion spring and which allows a screw gun to be used for winding the spring. A further advantage of the invention is to provide a torsion spring winding device which is easy to use on an existing garage door system and which is constructed of strong, durable materials. Another advantage of the invention is to provide a torsion spring torque assembly which allows for a controlled and safe installation procedure of garage door assemblies for both residential and commercial applications. Yet another advantage of the invention is to provide a winding assembly for use with various sizes of tension spring hubs. Yet another advantage of the invention is to provide a torsion spring torque assembly which is separable and reversible for unwinding a torsion spring.

These and other benefits of this invention will become clear from the following description by reference to the drawings.

DESCRIPTION OF THE PREFERRED EMBODIMENTS

Figure 6:
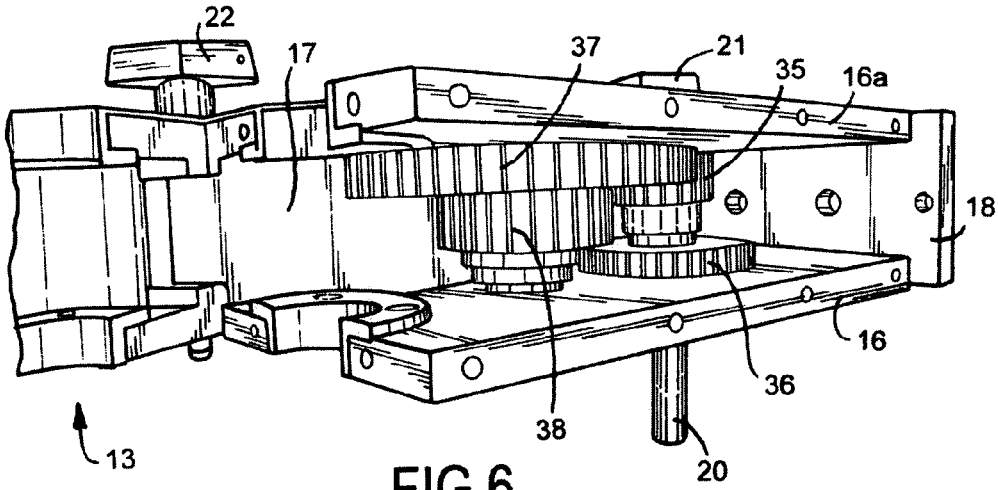
FIG. 6 is a bottom perspective view showing the gearbox assembly of the present invention with a housing plate removed to expose the internal drive gear structure.
Figure 7:
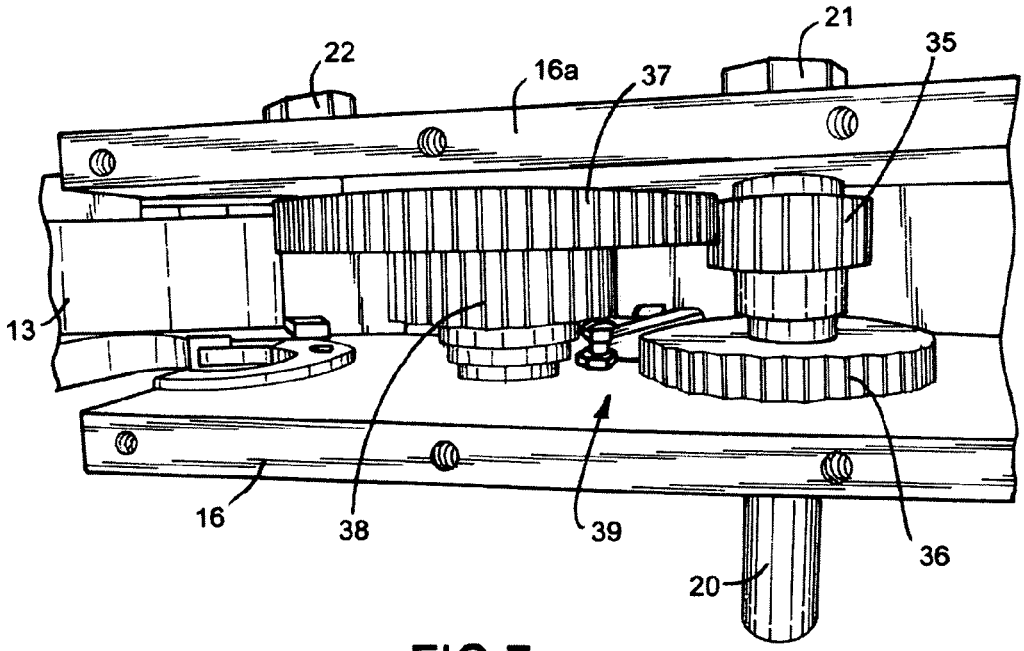
FIG. 7 is a close-up perspective view showing the drive gear structure of the gear assembly of FIG. 6.
Figure 16:
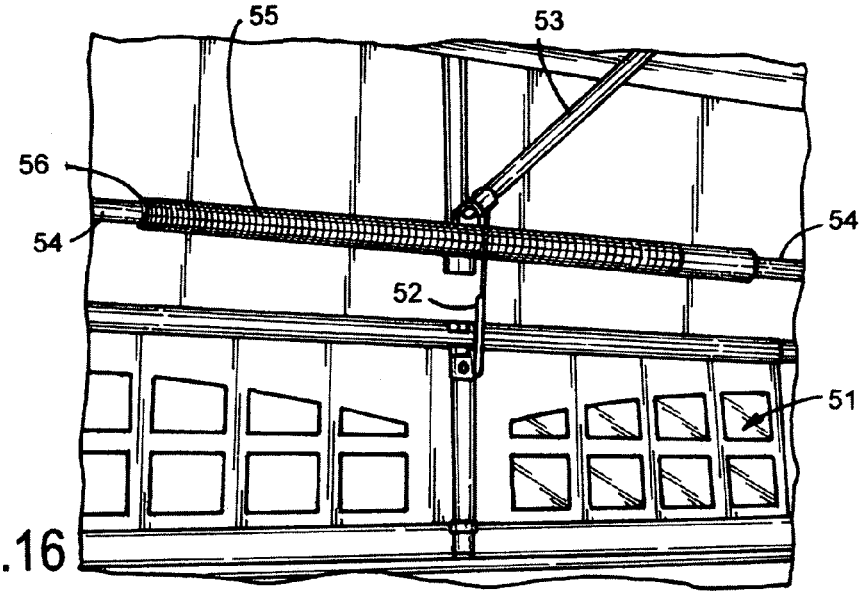
FIG. 16 is a perspective view of a garage door and torsion spring assembly.
Figure 17:
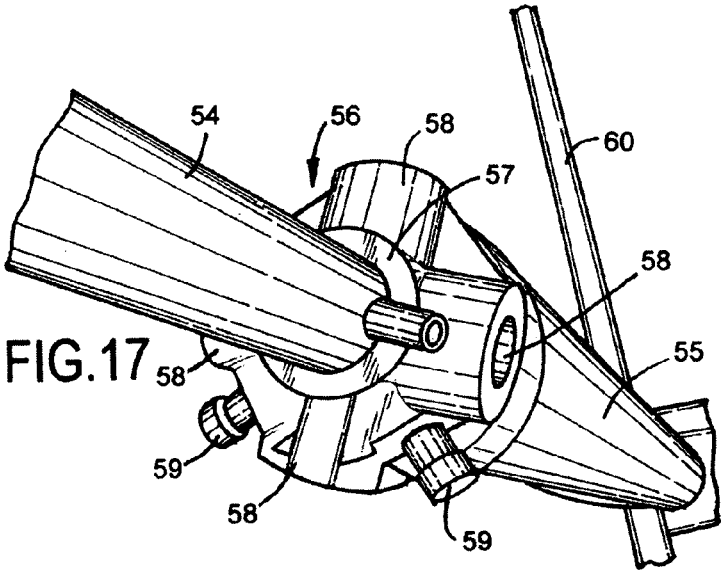
FIG. 17 is a perspective view showing the winding cone of the torsion spring assembly of FIG. 16.
Figure 18:
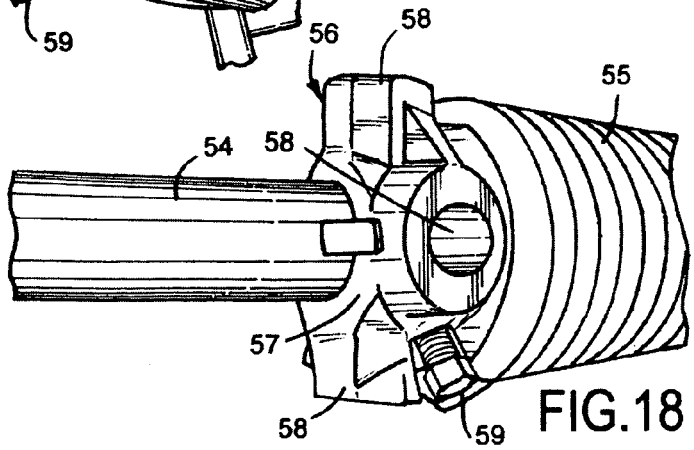
FIG. 18 is another perspective view of the winding cone of FIG. 17.
Figure 19:
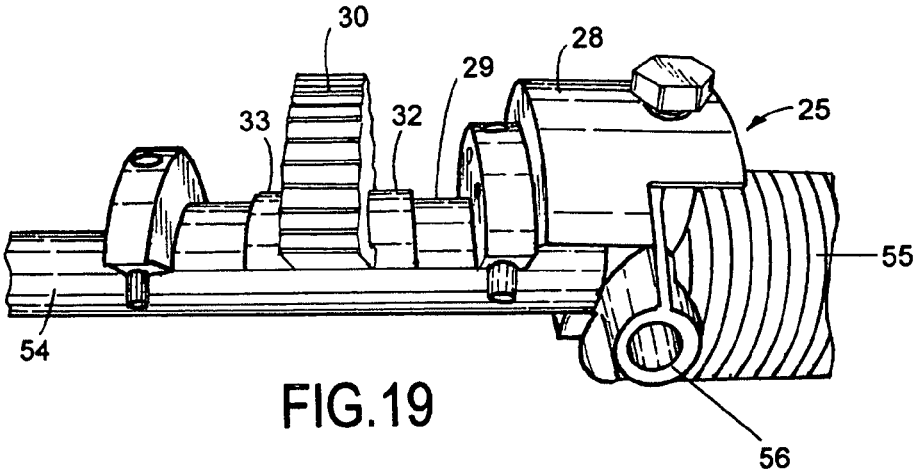
FIG. 19 is a perspective view showing one body half of the coupling shaft positioned on the winding cone of a garage door torsion spring.
Figure 20:
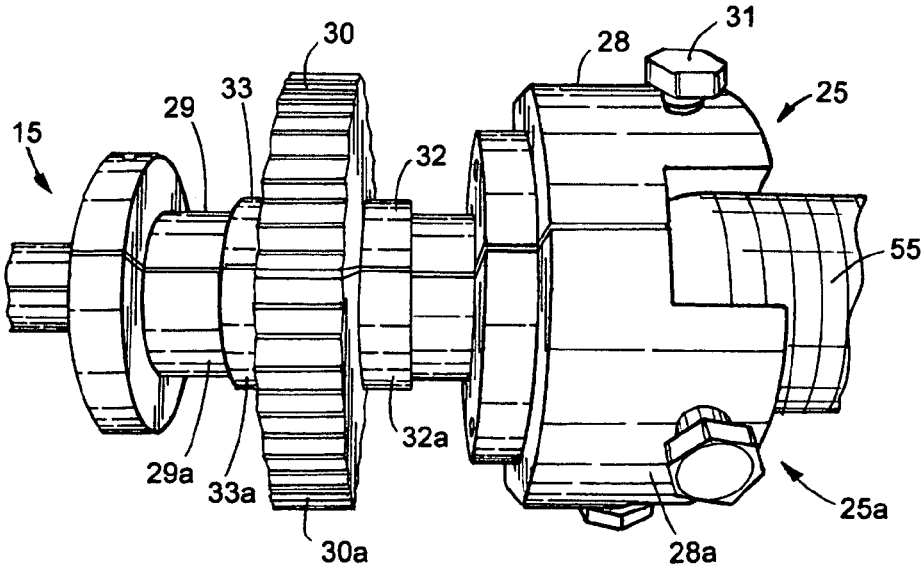
FIG. 20 is a perspective view of the coupling shaft mounted onto the winding cone a garage door torsion spring.

The torsion spring torque assembly 10 of the present invention is used to apply torque to the torsion springs of a garage door system, for example. A representative garage door system is shown in FIGS. 16-18 of the drawings. The torque assembly 10 is constructed and arranged to be mounted to the winding cone of each of the tension springs of the garage door system. In summary, FIGS. 1-5 show the torsion spring torque assembly 10 comprising gearbox assembly 11, sliding lever arm 14 and coupling shaft structure 15. FIGS. 6 and 7 show the gearbox assembly 11 with bottom plate 18*a* removed to expose the functional gear elements of the gearbox assembly 11 and in FIGS. 8-15 the individual gear components of the gearbox assembly are further shown. In FIGS. 19 and 20, the coupling shaft assembly 15 comprised of body halves 25 and 25*a* is shown installed on a torsion spring winding cone 56 of a torsion spring. Gearbox 11 is shown being installed onto coupling shaft assembly 15 in FIGS. 21-22 and, in FIGS. 23-26, the winding and unwinding processes of the torsion spring are shown utilizing the torsion spring torque assembly 10 of the invention.

Figure 1:
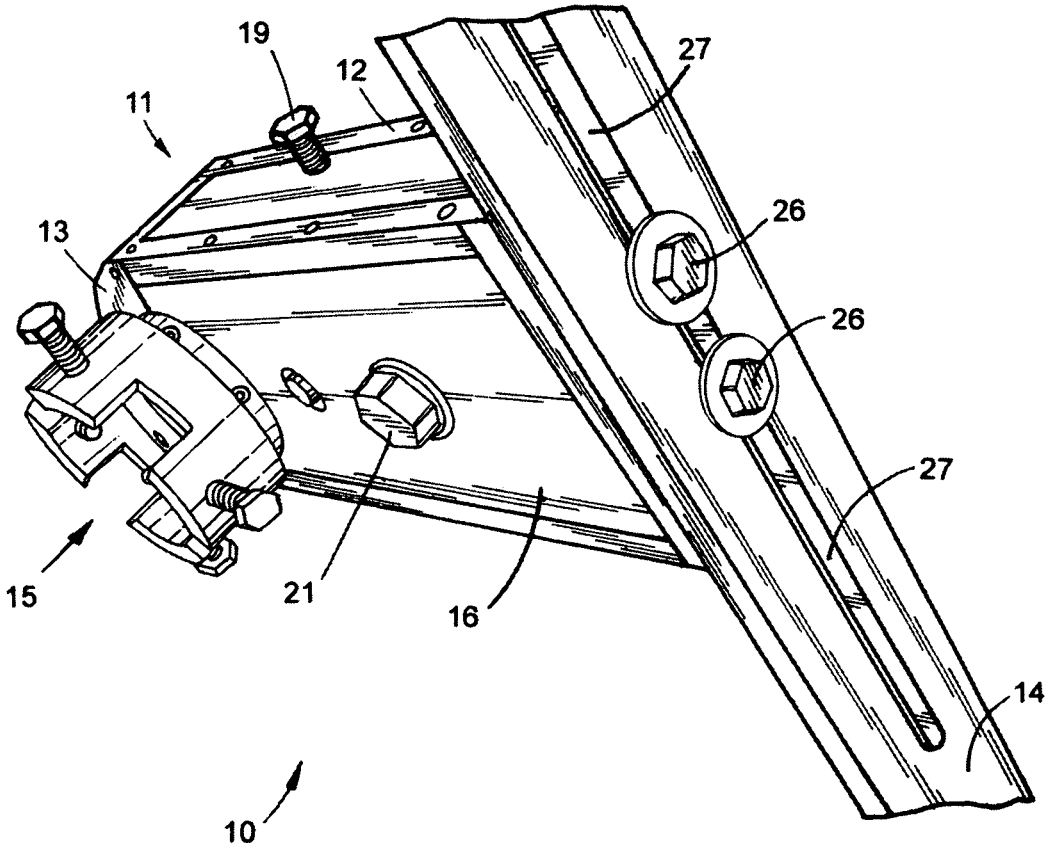
FIG. 1 is a rear perspective view showing the torsion spring torque assembly of the invention.

Referring to FIG. 1, the torsion spring torque assembly 10 is shown comprising coupling shaft structure 15, gearbox assembly 11 and sliding lever arm 14. Gearbox assembly 11 is shown comprised of housing structure 12 and endcap structure 13 and is constructed to have the support or sliding lever arm 14 attached thereto. Sliding lever arm 14 has elongated slots 27 through which bolts 26 are shown extended to support the structure of the gearbox assembly 11. Driver shaft end 21 is shown to permit the turning of the gear assembly arrangements housed in gearbox assembly 11 to wind the torsion spring of a garage door system. As further described below, particularly with respect to the OPERATION OF THE GEARBOX ASSEMBLY, the support or lever arm 14 is positioned against the inside of the garage door frame structure (FIG. 16) when the coupling shaft assembly 15 is mounted to the winding cone 56 (FIGS. 17, 18) of the torsion spring 55 for winding or unwinding purposes.

Figure 2:
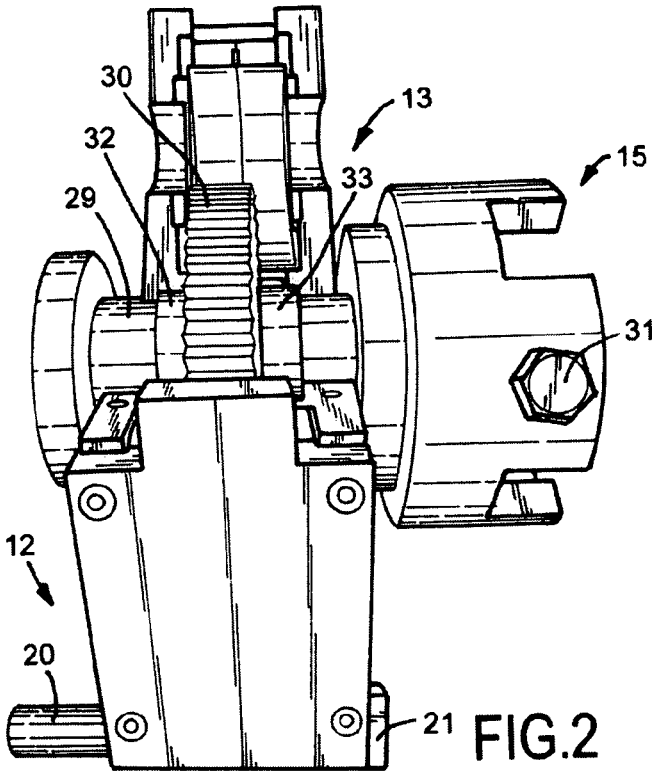
FIG. 2 is a top perspective view showing the gearbox assembly and the coupling shaft structure of the invention.
Figure 3:
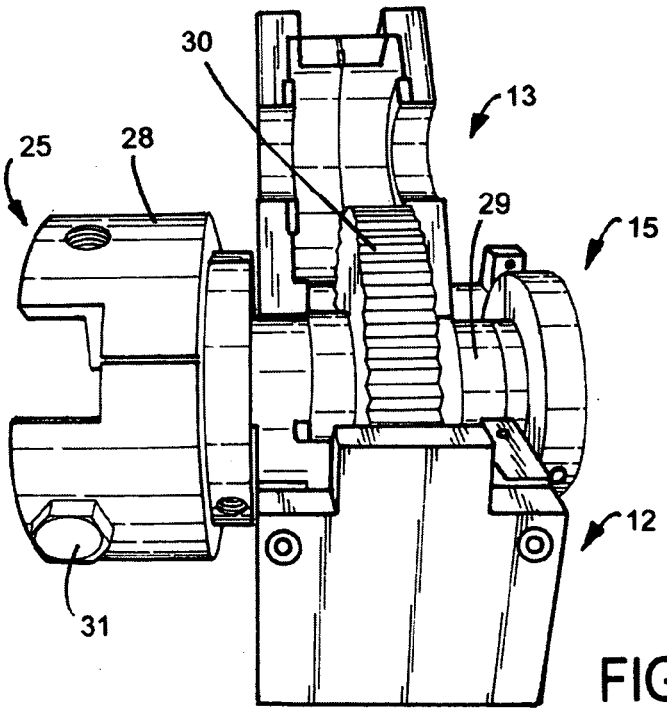
FIG. 3 is another top perspective view showing the gearbox assembly and showing the coupling shaft structure positioned in the opposite direction.

FIGS. 2 and 3 show the gearbox assembly 11 and the coupling shaft structure 15. As shown, the coupling shaft structure 15 has a generally centrally disposed driven gear assembly 30 which is installed, by welding or other known means, to the shaft portion 29 of coupling shaft structure 15. The generally centrally disposed driven gear assembly permits the coupling shaft structure 15 to be utilized with gearbox housing 11 and may be flipped for bi-directional use.

Figure 4:
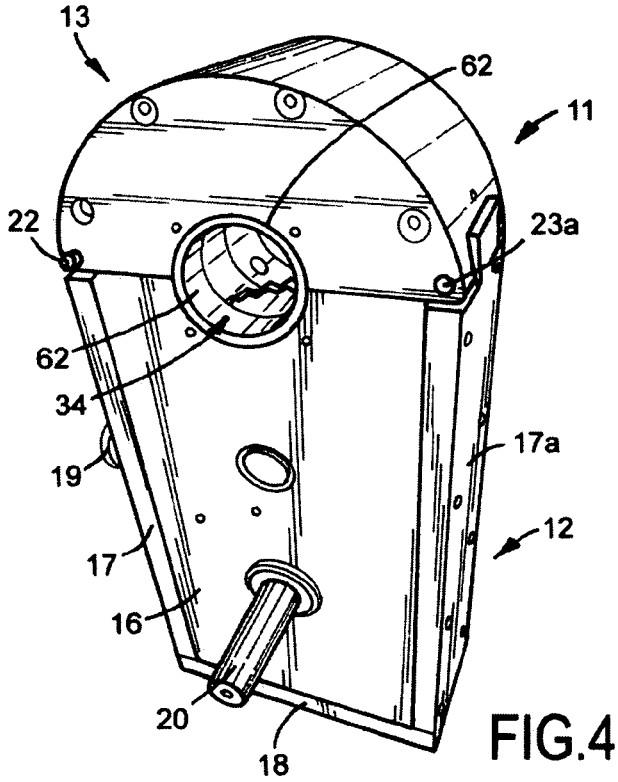
FIG. 4 is a lateral perspective view of the gearbox assembly of the present invention.
Figure 5:
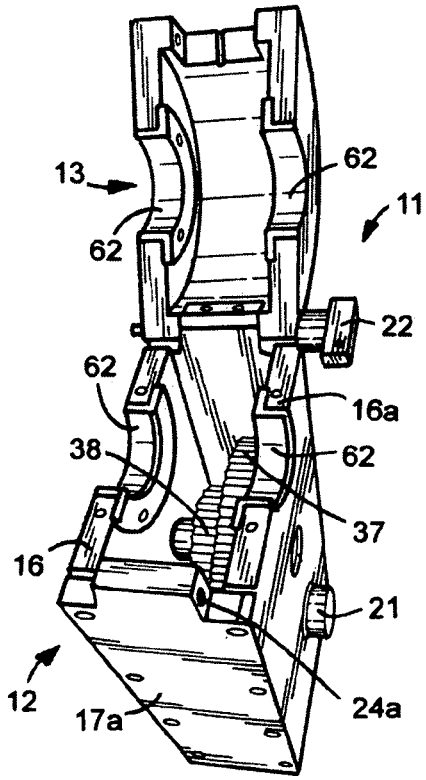
FIG. 5 is a top perspective view of the gearbox assembly of FIG. 4 showing the gearbox housing end cap in an open position.

Referring to FIGS. 4 and 5, the gearbox assembly 11 is shown having housing structure 12 with endcap structure 13 to provide the support structure and exterior cover for the cooperating gear arrangements and shaft elements of the gearbox assembly 11. Housing structure 12 is shown constructed of gearbox side plates 16, 16*a*, top plate 17 and bottom plate 17*a* and end plate 18. Endcap structure 13 is shown to be a pivotable structure having a curved body end. Circular aperture 34 is shown defined by hemispherical bushings 62 in housing 12 and in endcap 13 and is constructed to engage the shaft portions 29, 29*a* of coupling shaft assembly 15. The bushing halves 62 are shown disposed in the hemispherical openings of housing 12 and endcap 13 and are preferably constructed of brass or other durable material. Pivoting pin structure 22 is shown extending through endcap 13 and housing 12 and which permits endcap 13 to pivot with respect to housing 12. Corresponding locking pin 22*a* (not shown) is removed from apertures 23*a* in endcap 13 and 24*a* in housing 12 to permit pivoting about pivot pin 22. The hexagonal head end 21 of input drive shaft 20 is shown extending from side plate 16*a* of housing 12. The input drive shaft 20 turns the driver gear to thereby turn the cooperating gear arrangements to wind the garage door torsion spring, as further described below. Release button 19 is shown extending from top plate 17 of housing 12 and which is constructed to act upon the pawl mechanism to permit the unwinding of a garage door torsion spring, as also discussed below.

Referring again to FIGS. 4 and 5, extending from and adjustably mounted to the support or sliding lever arm 14 (FIG. 1) is a generally rectangular housing or box-like structure 11 which supports and covers the cooperating gears and shafts as well as the coupling shaft assembly 15 (halves 25, 25*a*), the latter for engaging the winding cone of the torsion spring of the garage door system. As further shown, gearbox end plate 18, gearbox side plates 16, 16*a*, gearbox top plate 17 and bottom plate 17*a* form the housing 12 and with gearbox end cap 13 cover and support the gear and shaft elements of the gearbox assembly 11. Other housing and support structures are within the purview of the present invention.

FIGS. 6 and 7 show the gearbox housing 12 with bottom plate 17*a* removed to expose the functional gear and shaft elements of the gearbox assembly 11. Driver shaft 20 is shown extending through driver gear 35 and ratchet gear 36. Spring loaded pawl mechanism 39 is shown and which acts on ratchet gear 36 to provide one-directional gear rotation. Idler gear 37 is shown in rotational communication with driver gear 35 and positioned on a shaft having reduction gear 38. Reduction gear 38 is shown generally centrally located within housing structure 12 for rotational communication with driven gear 30, 30*a* which is shown generally centrally disposed on coupling shaft structure 15 (FIGS. 2-3, 8-10).

Referring again to FIGS. 2-3, the coupling shaft assembly 15 having body halves 25, 25*a* is shown extending outwardly and supported between housing side plates 16, 16*a*. Coupling split gear 30,30*a*, a four inch gear, for example, is shown mounted around the coupling shaft 56. As shown in FIGS. 6-7, reducing gear 38 and idler gear 37, are shown in rotational communication between coupling shaft driven gear 30 and driver gear 35, a one inch gear, for example. Driver gear 35 is shown positioned adjacent to ratchet gear 36 and which are driven by input drive shaft 20. A ratchet gear locking lever or pawl mechanism 39 is shown in communication with the teeth of ratchet gear 36 and which provides two-directional rotation for the driver shaft and thus gears 35, 37 and 38. Pawl mechanism 39 is spring loaded and may be unactivated from gear 36 by depressing release button 19 to thereby provide bi-directional gear movement.

Figure 8:
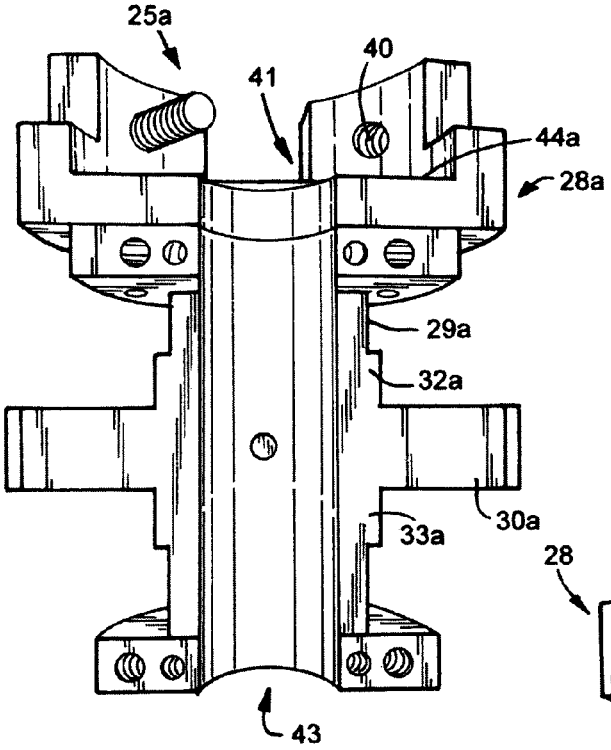
FIG. 8 is a perspective interior view of a coupling shaft body half for coupling to the winding cone of a garage door torsion spring.
Figure 9:
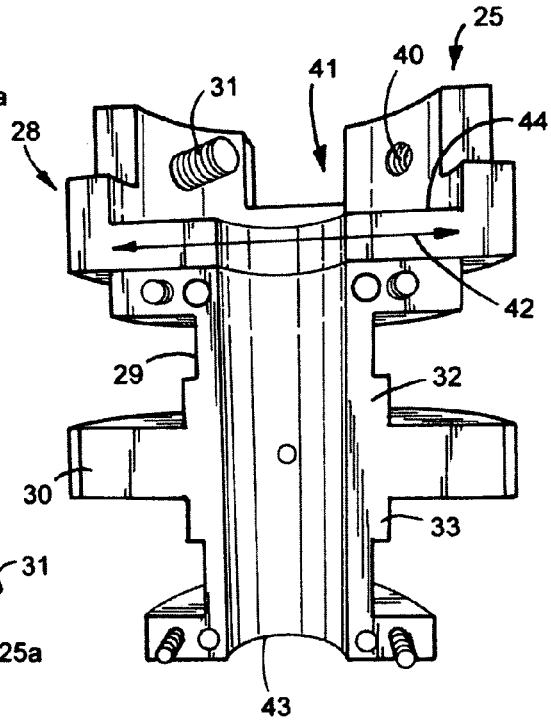
FIG. 9 is a perspective view of the coupling shaft body half used with the body half of FIG. 8.
Figure 10:
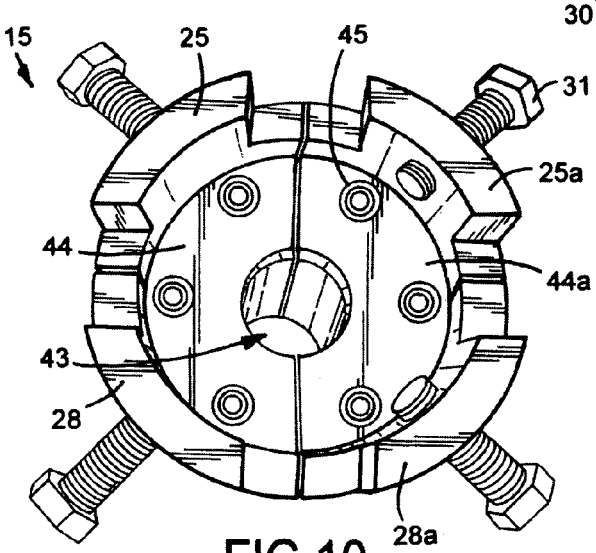
FIG. 10 is a front perspective view of the coupling shaft hub formed by the body halves of FIGS. 8 and 9.
Figure 11:
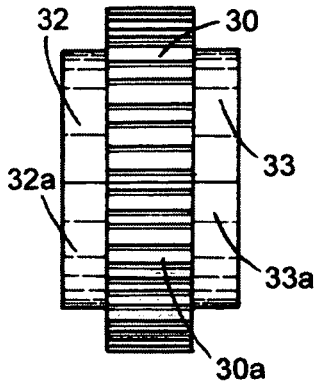
FIG. 11 is a perspective view showing the coupling shaft split gear of the gear assembly of the invention.
Figure 12:
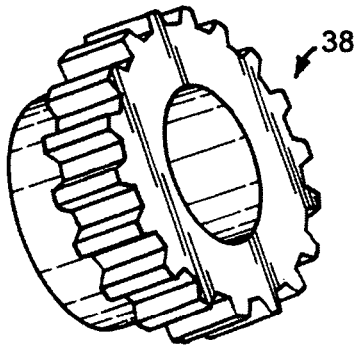
FIG. 12 is a perspective view showing the reduction gear of the gear assembly.
Figure 13:
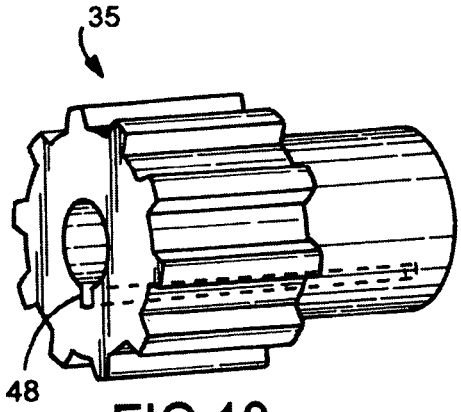
FIG. 13 is a perspective view showing the driver gear of the gear assembly.
Figure 14:
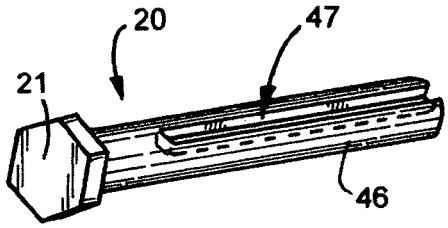
FIG. 14 is a perspective view of the input drive shaft of the gear assembly.
Figure 15:
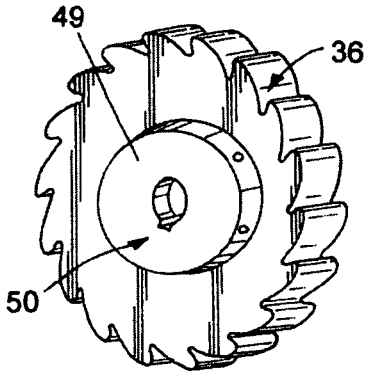
FIG. 15 is a perspective view of the ratchet drive gear used in the gear assembly of the invention.

Referring to FIGS. 8-15, the cooperating gears and shafts of the torque assembly 10 are shown. Several of the individual gear and shaft elements are further individually shown in FIGS. 11-15. Specifically, coupling shaft halves 25, 25*a* are shown in FIGS. 8-10, driven gear comprising coupling shaft split gear portions 30 and 30*a*, is shown in FIG. 11, reduction gear 38 is shown in FIG. 12, driver gear 35 is shown in FIG. 13, the drive shaft 20 is shown in FIG. 14, and a ratchet gear 36 is shown in FIG. 15. The components of the gearbox assembly are preferably constructed of a strong, rigid and durable material, i.e., a metal, metal alloy, aluminum and the like.

In use, the torsion spring torque assembly 10 is initially partially dismembered so that the coupling shaft body halves 25, 25*a* may be positioned and mounted to the winding cone 56 of tension spring 55 of the garage door assembly, as described below in Operation of the Gearbox Assembly.

As shown in FIGS. 16-18, garage door structure 51 has panels which by means of pull bar 52, track chain/belt 53, cable 60 and counterbalancing torsion springs 55 (TS1, TS2) provide the automatic opening and closing sequence when the garage door opener is activated. Torsion spring 55 is shown wound around horizontal drive bar 54 and the end of spring 55 is secured to the drive bar 54 by winding cone 56 by means of set screws 59. Winding cone 56 with outer face 57 is also shown having apertures 58 which are typically used by installers to turn cone 56 mechanically by hand. When the present invention is utilized, the coupling shaft assembly 15 is initially secured to cone 56 as shown by the identified positions of FIGS. 17 and 18, i.e., bolts 31 (see FIGS. 10, 21-22) are threaded into apertures 58 of the winding cone 56 and secured against drive bar 54.

Referring to FIGS. 19-20, the coupling shaft assembly 15 is shown having body halves 25 and 25*a*. Each body half 25, 25*a* includes a shaft portion 29, 29*a* for mounting around drive bar 54 and a separable winding hub portion 28, 28*a* for mounting about winding cone 56. Driven gear components 30, 30*a* are shown having shaft portions 32, 32*a*, 33 and 33*a* to engage shaft portions 29, 29*a* of each coupling shaft body half, respectively.

Operation of Gearbox Assembly

Figure 21:
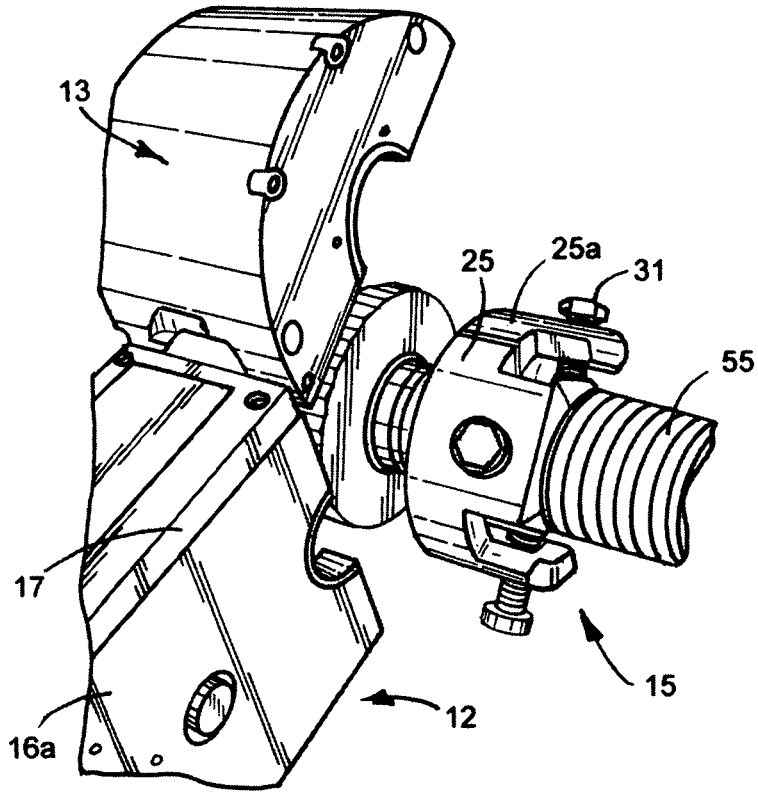
FIG. 21 is a perspective view of the gearbox end cap being placed around the coupling shaft mounted to the winding cone of a garage door torsion spring.
Figure 22:
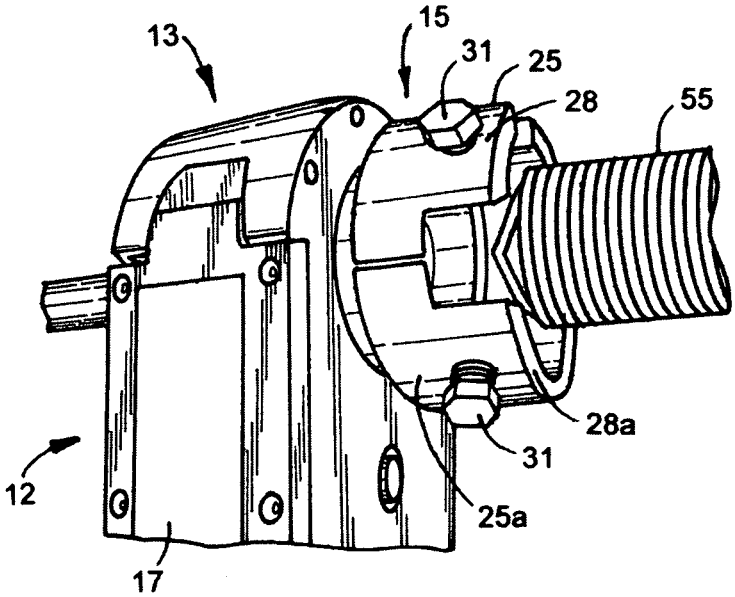
FIG. 22 is a perspective view of the torsion spring torque assembly with the coupling shaft installed for use.
Figure 23:
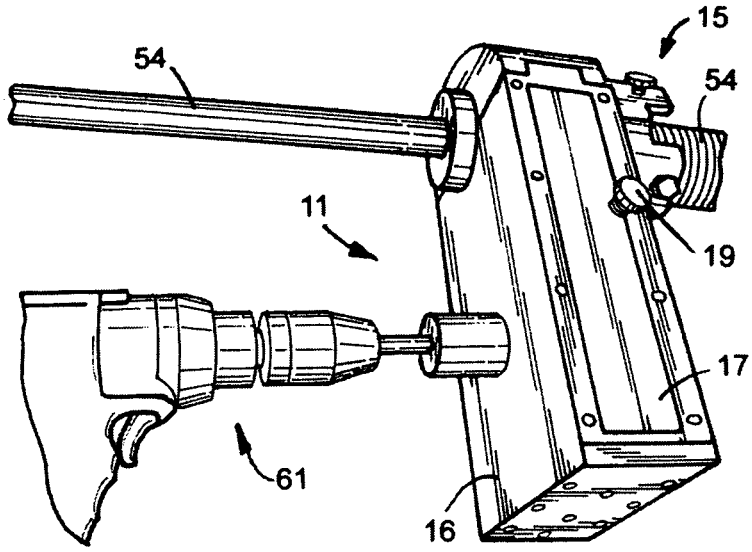
FIG. 23 is a perspective view showing an electric drill engaging the torsion spring torque assembly being used to wind a garage door torsion spring.
Figure 24:
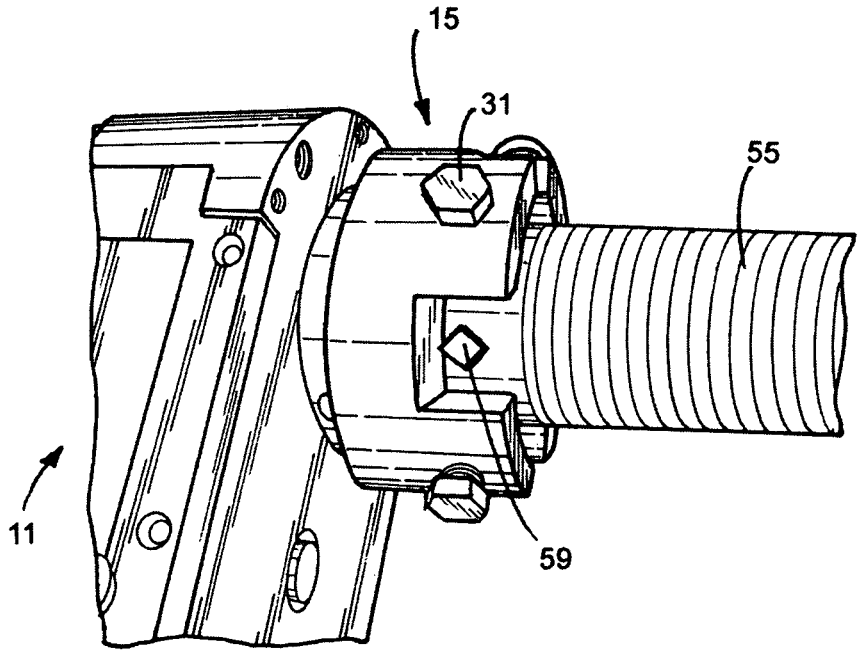
FIG. 24 is a perspective view showing the set screw of the garage door torsion spring winding cone.
Figure 25:
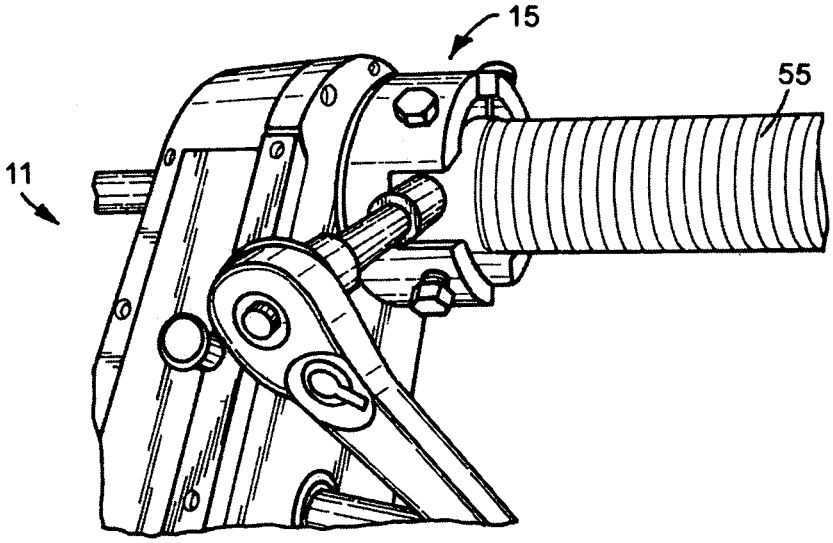
FIG. 25 is a perspective view of the tightening of the set screw of the winding cone of the garage door torsion spring assembly.
Figure 26:
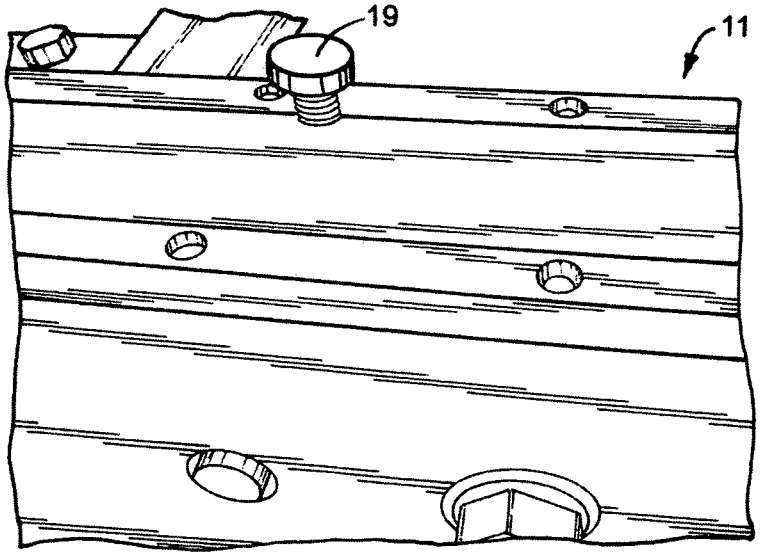
FIG. 26 is a close-up perspective view of the gearbox assembly showing the gearbox pawl release button.

The torsion spring torque assembly 10 of the invention is used as a torsion spring winding device as follows:

1. The proper size winding hub portions 28, 28*a* are initially installed onto the coupling shaft body halves 25 and 25*a*. Winding hub bolts 45 (shown in FIG. 10) are removed to allow the proper size winding hub 28, 28*a* to be attached to the coupling shaft body halves 25 and 25*a*, respectively, to accommodate the different sizes of winding cones used in the industry.
2. Coupling shaft body halves 25 and 25*a* are next bolted to the garage door winding cone 56 of torsion spring 55 shown located above the garage door in FIG. 16. The coupling shaft locking bolts 31 may be pre-threaded in apertures 40 of the coupling shaft body halves 25 and 25*a*. Locking bolts 31 may then be hand tightened into the winding bar slots 58 on the winding cone 56.
3. One gearbox endcap pin 22 or 22*a* is removed, to permit gearbox end cap 13 to pivot into an open position, as shown in FIG. 21. Gearbox endcap 13 fits around coupling shaft structure 25 which is already installed on the garage door torsion spring 55, as shown in FIG. 22. Replacement of endcap pin 22 or 22*a*, through apertures 23, 24 or 23*a* 24*a* in the endcap 13 and gearbox housing 12, respectively, secures the gearbox assembly 11 to the coupling shaft structure 15, as shown in FIG. 22. (The gearbox assembly 11 may be installed in either direction on the coupling shaft to enable the winding of the garage door torsion spring in the desired direction. Thus, the gearbox assembly can attach to the coupling shaft in both directions to accommodate left and right wound springs.)
4. The sliding lever arm 14 is now adjusted up or down to snugly fit against the inside face of the garage door frame. This configuration stabilizes the assembly 10 during use. Sliding lever arm 14 is shown in FIG. 1.
5. As shown in FIG. 23, an electric drill, impact gun or screw gun 61 with a socket attachment is positioned onto the end 21 of the input drive shaft 20 to apply rotational force.
6. The twisting or rotational force from the gun socket rotates input drive shaft 20 and thus driver gear 35, reduction gear 38, in a counter rotational direction, and coupling shaft split gear 30, 30*a*, which is welded or otherwise connected to coupling shaft structure 15. The turning of the coupling shaft structure 15, which is attached to the winding cone 56 of the garage door torsion spring 55, thereby winds the torsion spring.
7. The torsion spring is wound to manufacturer's specifications. The set screws 59, shown in FIG. 24, on the garage door torsion spring winding cone 56 are now tightened, as shown in FIG. 25, to lock the spring 55 in its wound or torqued position.
8. The gearbox end cap 13 is pivoted open from housing 12 to remove the gearbox assembly 11 from the coupling shaft structure 15.
9. The coupling shaft structure 15 is now removed from the winding cone 56 of garage door torsion spring 55.
10. The torsion spring winding process is complete.

The gearbox assembly 10 of the invention is used as a torsion spring un-winding device as follows:

1. Install the coupling shaft halves 25, 25*a* onto the winding cone 56 of the garage door torsion spring 56 and the gearbox assembly 55 onto the coupling shaft structure 15 and the sliding lever arm 14 as previously described in steps 1-4 of the winding process.
2. The set screw(s) 59 of the garage door torsion spring are loosened to unlock the spring from its previous location allowing it to transfer all the force onto the gears of the gearbox assembly 10.
3. Next press gearbox release button 19 shown in FIG. 26 on top of the gearbox down fully to release all the spring's potential energy. This will allow the garage door spring 55 to unwind itself.
4. The unwinding Process is complete. The gearbox 11 and coupling shaft structure 15 are removed.

It is within the purview of the present invention to change the gear ratios of the gear arrangement of gearbox 11. For example, gear sizes may be increased or decreased and additional reduction gears may be used to provide a gearbox 11 that may be driven by a standard screw gun or the like to apply a specified torque to a specified torsion spring. Also, as known in the art, appropriate bearings and bushings may be utilized in conjunction with the gears and shafts used in the gearbox assembly of the invention.

A pawl may be used on ratchet gear 36 to engage the teeth of the ratchet gear. It is within the purview of the invention to utilize a spring on the pawl structure so as to provide a continuous biased contact of the pawl with the gear teeth. A pin structure may also be utilized to remove or disengage the pawl from the gear teeth when desired. The latter spring and pin structures being known in the art.

As shown in FIG. 15, the ratchet gear 36 has an adjustment hub 49 mounted thereto and which may be rotated (loosened and moved) for incremental or small adjustments of the ratchet gear.

As further shown in FIGS. 8-9, the connecting end of the coupling shaft halves 25, 25*a* with bore 43 may have varied internal bore diameters, as indicated by arrow 42, to accommodate garage door shafts 54 of different diameters. For example, in residential garage door applications, a shaft 54 diameter of three inches may typically be encountered, whereas in commercial garage door applications, a larger diameter shaft diameter may typically be utilized. Thus, an internal bore diameter 42 may range from three to four or eight to twelve inches, for example. Therefore, shaft halves may be provided having IDs of approximately 3.5, 6, 8, and 11.5 inches or any other diameter to accommodate the appropriate garage door shaft.

As shown in FIG. 14, the shaft portion 46 of drive shaft 20 has a keyway 47 which is aligned with the keyway 48 of driver gear 35, as shown in FIG. 13, and the keyway 50 of the ratchet gear 36, as shown in FIG. 15, so that a key (not shown) may be positioned in the respective keyways to provide a locked, unitary structure.

In summary, the gearbox assembly 11 is a separable structure so that the coupling shaft hubs 25, 25*a* may be mounted to a winding cone 56 of a garage door system. Therefore, the gearbox assembly 11 is reassembled so that the winding cone may be loosened from garage door shaft 54 so that the torsion spring 55 may be wound. It is within the purview of the invention to use a pre-assembled coupling shaft structure that is attached to torsion spring 55 instead of a winding cone 56 when the garage door system is initially installed. The gearbox assembly 11 would accordingly be restructured to accommodate the preinstalled coupling shaft structure.

The use of split gear 30, 30*a* provides a structure which centers the driven gear within the gearbox 11. Utilizing the generally centrally aligned driven gear 30, 30*a* and with the generally centrally aligned reducing gear allows the gearbox assembly 11 to be placed onto the coupling shaft structure in either direction, as shown in FIGS. 2 and 3, to allow either winding or unwinding of a torsion spring. Use of different hub sizes on the coupling shaft structure to accommodate different winding cone sizes further provides flexibility in the use of the torsion spring torque assembly 10 of the present invention.

As many changes are possible to the torsion spring torque assembly of this invention, utilizing the teachings thereof, the description above and the accompanying drawings should be interpreted in the illustrative and not the limited sense.

That which is claimed is:

1. A torsion spring torque assembly comprising:

a) a gearbox assembly having a separable housing structure having an adjustable plate connected thereto for positioning against the inside of a garage door structure to apply torque to a torsion spring hub;

b) a gear assembly supported by said housing structure, said gear assembly having a ratchet gear with a pawl for one directional rotation, a driver gear, means to drive said driver gear and at least one reducing gear; and e) a driven gear assembly communicating with said gear assembly, said driven gear assembly having a separable hub structure for coupling to the winding cone of a torsion spring.

2. The torsion spring torque assembly of claim 1, wherein said pawl is operable from the outside of said housing structure.

3. The torsion spring torque assembly of claim 1, wherein said drive means has a head extending from said housing structure for receiving a screw gun socket.

4. The torsion spring torque assembly of claim 1, wherein said housing structure has a pivotable end structure for providing access to said driven gear assembly.

5. The torsion spring torque assembly of claim 4, wherein said driven gear assembly has a generally centrally disposed driven gear.

6. The torsion spring torque assembly of claim 5, wherein said driven gear assembly is reversible for winding and unwinding a torsion spring.

7. The torsion spring torque assembly of claim 1, wherein said torsion spring torque assembly is constructed of metal or aluminum.

8. The torsion spring torque assembly of claim 1, wherein said separable hub structure has peripheral apertures.

9. The torsion spring torque assembly of claim 1, wherein said pawl is spring loaded and has a button operative from the outside of said housing structure for engaging and disengaging said ratchet gear.

10. A torsion spring torque assembly comprising:

a) a separable housing enclosure having a generally flat rear portion;

b) an elongated support member adjustably mounted to said generally flat rear portion of said separable housing enclosure;

c) a gear assembly arrangement having a pawl for one directional rotation, a driver gear and at least one reducing gear, said gear assembly positioned in said separable housing; and d) a driven gear assembly communicating with said gear assembly arrangement, said driven gear assembly having a separable hub structure for coupling to the winding cone of a shaft having a torsion spring.

11. The torsion spring torque assembly of claim 10, wherein said housing enclosure has an aperture and a button extending therethrough, said button operative on said pawl.

12. The torsion spring torque assembly of claim 10, wherein said housing enclosure includes a hinged front portion for access to said driven gear assembly.

13. The torsion spring torque assembly of claim 10, wherein said separable housing enclosure and said support member are formed of Aluminum and said gear assembly arrangement and said driven gear are formed of a steel or steel alloy composition.

14. The torsion spring torque assembly of claim 10, wherein said separable hub structure is constructed to surround a winding cone of a torsion spring.

15. The torsion spring torque assembly of claim 14, wherein said separable hub structure includes a plurality of hub structures, each having a specified diameter to thereby accommodate winding cones of different sizes.

16. The torsion spring torque assembly of claim 10, wherein said driver gear has drive means accessible outside said separable housing enclosure.

17. The torsion spring torque assembly of claim 16, wherein said drive means is constructed to receive a screw gun socket.

18. A method for winding a torsion spring of a garage door comprising:

a) ding a torsion spring torque assembly according to claim 10;

b) coupling said separable hub structure to the winding cone of a torsion spring;

c) engaging said driven gear with a screw gun;

d) winding the torsion spring to a specified torque;

e) securing the winding cone to the torsion shaft; and f) removing said winding hub structure from the winding cone.

19. The method of claim 18, wherein said torsion spring assembly provided further comprises said housing enclosure having an aperture and a bottom extending therethrough and wherein said button is operative on said pawl.

20. The method of claim 18, wherein said torsion spring further comprises said housing enclosure including a hinged front portion for access to said driven gear, wherein said separable hub structure is constructed to surround the winding cone and wherein said separable hub structure includes a plurality of hub structures, each having a specified diameter to thereby accommodate winding cones of different sizes.

* * * * *